United States Patent [19]

Mersereau et al.

[11] 4,052,051

[45] Oct. 4, 1977

[54] SHEET FEEDER

[75] Inventors: Robert E. Mersereau, Stamford; Harold Silverman, Norwalk, both of Conn.

[73] Assignee: Pitney-Bowes, Inc., Stamford, Conn.

[21] Appl. No.: 719,300

[22] Filed: Aug. 31, 1976

Related U.S. Application Data

[63] Continuation of Ser. No. 594,869, July 10, 1975, abandoned.

[51] Int. Cl.[2] ..... B65H 3/12

[52] U.S. Cl. ..... 271/94; 271/31; 271/126; 271/159; 271/155

[58] Field of Search ..... 271/3.1, 94, 31, 111, 271/126, 157, 158, 159

[56] References Cited

U.S. PATENT DOCUMENTS

| | | | |
|---|---|---|---|
| 2,058,979 | 10/1936 | Henry | 271/94 |
| 2,247,466 | 7/1941 | Baker | 271/155 |
| 2,654,603 | 10/1953 | Williams | 271/159 |
| 2,952,458 | 9/1960 | Watts | 271/159 |
| 2,997,298 | 8/1961 | Elliott | 271/159 |
| 3,035,835 | 5/1962 | Reif | 271/159 |

*Primary Examiner*—Richard A. Schacher

*Attorney, Agent, or Firm*—Donald P. Walker; Wiliam D. Soltow, Jr.; Albert W. Scribner

[57] ABSTRACT

A top-of-stack sheet feeder includes a stack lifting apparatus which provides uniform stack pressure at the feeder as well as stack replenishment without interruption of feeder operation. The stack lifting apparatus includes a comblike feeding platform which incrementally elevates a feed stack to a feed roller which removes successive top sheets. Platform elevation control is responsive to requirement signals generated by a top sheet height sensor. When the stack is depleted to a predetermined reserve, a pair of opposed comblike feeding decks interfit between spaces in the feeding platform and assume the stack elevation function after which the platform descends to a loading station to receive a new stack and lift same to the decks. Upon introduction of the new stack, the decks disengage the reserve and index to a lower dwell station ready to again resume stack lifting when the combined stack reaches the reserve level.

The feed roller includes a perforated sleeve rotating about a fixed core having a peripherally open vacuum sector. The top sheet is lifted from the stack by the vacuum, assisted by a pair of air rifflers which induce air jets under the top sheet and is transported to acceleration rollers by the rotation of the feed roller.

10 Claims, 8 Drawing Figures

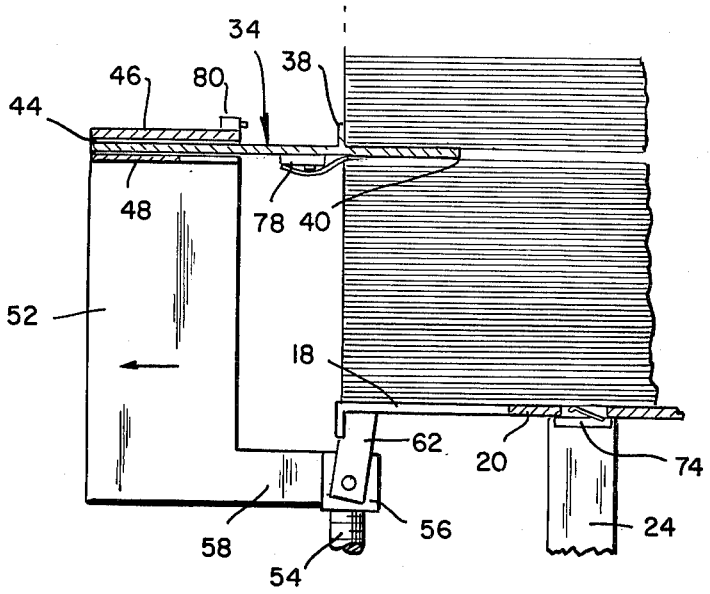
FIG. 4
FIG. 5
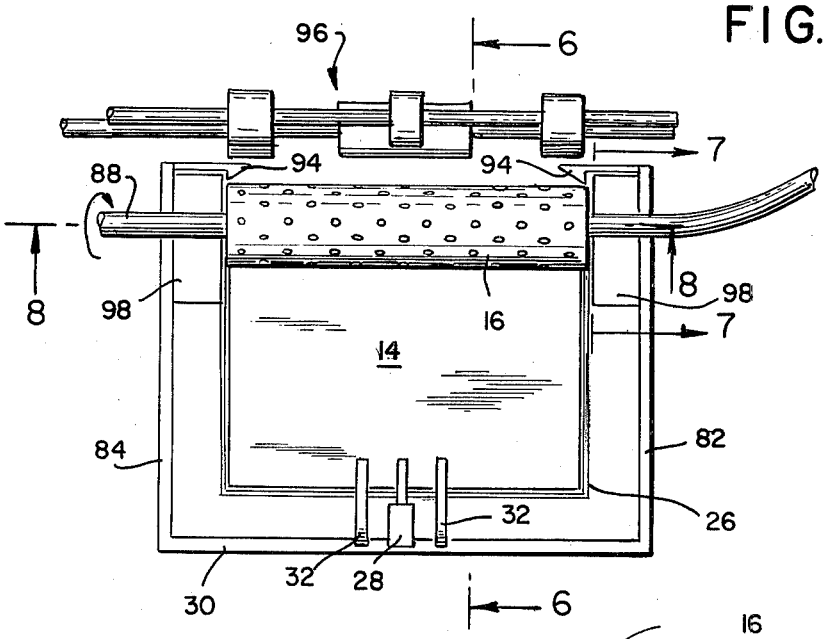
FIG. 6
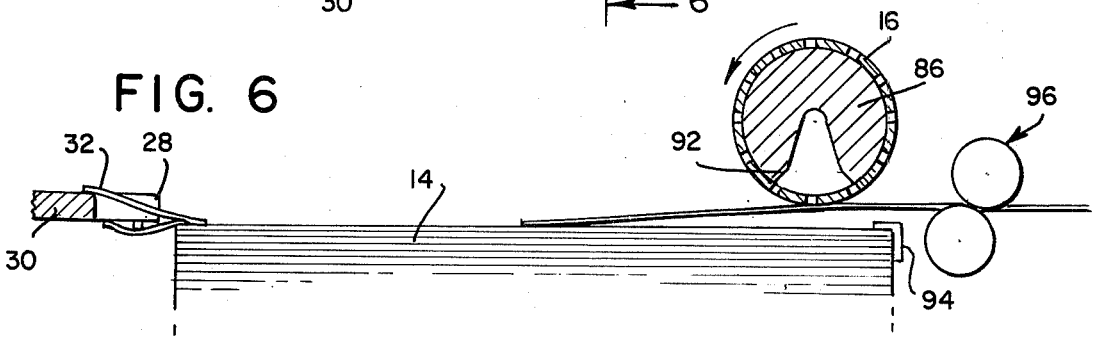
FIG. 7
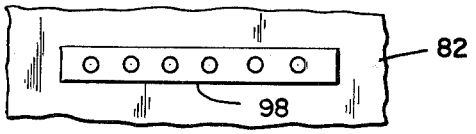

SHEET FEEDER

This is a continuation of application Ser. No. 594,869 filed July 10, 1975 now abandoned.

BACKGROUND OF THE INVENTION

1. Field of the Invention

The invention relates generally to sheet feeding, separating and transporting apparatus and more particularly to bottom loading sheet feeders adapted for use in conjunction with continuous flow automated document processing systems.

2. Description of the Prior Art

Sheet feeding apparatus have provided sheet removal and transfer from a stack of sheets lying in either horizontal or vertical planes. Generally, these sheet feeders were adapted to separate in seriatim a batch of sheets with the feed stack or bundle constituting the batch. Depletion of the batch necessitated reloading the feeder magazine and usually implied interruption of feeder operation. The reloading function has generally been performed manually even with information storage and retrieval system feeders.

While it may have been possible to automatically or manually resupply a depleting stack carried in a magazine above a bottom-of-stack sheet feeder, various disadvantages have been encountered with respect to bottom-of-stack feeders when attempts were made to utilize such feeders for continuous high speed delivery and transport of sheets. Poor reliability has been encountered with such feeders primarily due to their sensitivity to variable stack pressures and concomitant variations in intersheet friction.

Sheet feeders designed for separating and transporting stacks of sheets oriented edgewise, i.e. in vertical planes, were primarily designed for utilization in instances where the sheets were substantially self-supporting in such vertical planes, e.g. envelopes, cards, checks, etc., and such feeders have thus been found to be impractical for utilization where letter size papers are to be separated from a stack.

Top-of-stack sheet feeding mechanisms generally separated the top sheet through a shingling process which often employed a reverse drive wheel to retard double feeding. While such systems were practical in instances wherein the sheets had reasonable stiffness, e.g. envelopes, cards, etc., they too could not be reliably employed to feed single sheets of paper.

Most prior feeders utilized a variable force for engaging the stack against a feed roller. In some instances a spring loader applied pressure to the end of the stack, while in others the feeder itself was biased to dip into the stack as the stack was being depleted. These prior devices permitted variations in stack pressure which affected feeder reliability and versatility.

SUMMARY OF THE INVENTION

In accordance with the present invention, a continuous top-of-stack sheet feeder for sheets stacked in a horizontal plane is provided with a stack lifting apparatus which minimizes and prevents fluctuations in stack pressure by elevating the stack in response to removal of successive top sheets as detected by a top sheet height sensor. Stack lifting is achieved by incremental elevation of a comblike feeding platform, and upon the platform reaching a position indicative of a measured stack reserve, a pair of opposed comblike decks engage the stack between spaces of the platform to assume stack elevation in response to removal of successive top sheets.

The platform then descends to receive a new stack and elevate the new stack to combine with the stack reserve transitorily elevated by the decks. A sensor signals the presence of the top sheet of the new stack against the undersurface of the feed decks to initiate feed deck disengagement and indexing to a lower dwell position.

The sheet feeder includes a vacuum feed roller having a perforated cylinder rotating about a fixed core which includes an open, longitudinal vacuum sector or channel. While the vacuum lifts the top sheet, rotation of the roller serves to transport the sheet to a set of acceleration rollers. Top sheet separation is assisted by a pair of air rifflers positioned adjacent opposite ends of the feed roller and which induce pulsating air jets under the top sheet to reduce drag between the sheets and inhibit double sheet feeding.

From the foregoing, it will be appreciated that it is an object of the present invention to provide a sheet feeder of the general character described which, however, is not subject to the disadvantages aforementioned.

It is a further object of the present invention to provide a sheet feeder of the general character described which is particularly well suited for high speed sheet feeding in a continuous automated system.

A further object of the present invention is to provide a sheet feeder of the general character described which provides continuous reliable high speed feeding of individual sheet paper documents.

Another object of the present invention is to provide a stack lifting apparatus for a sheet feeder of the general character described which permits stack replenishment without interruption of feeder operation.

Yet another object of the present invention is to provide a stack lifting apparatus for a sheet feeder of the general character described which provides constant stack pressure.

A further object of the present invention is to provide a stack lifting apparatus for a sheet feeder of the general character described wherein stack pressure is minimized.

A further object of the present invention is to provide a stack lifting apparatus for a sheet feeder of the general character described wherein a stack lifting deck is transitorily engageable to provide continuity of feeding when the sheet supply is being replenished.

Other objects of the invention in part will be apparent and in part will be pointed out hereinafter.

With these ends in view, the invention finds embodiment in certain combinations of elements and arrangements of parts by which the objects aforementioned and certain other objects are hereinafter attained, all as fully described with reference to the accompanying drawings and the scope of which is more particularly pointed out and indicated in the appended claims.

BRIEF DESCRIPTION OF THE DRAWINGS

In the accompanying drawings, in which is shown one of the possible exemplary embodiments of the invention:

FIG. 4 is an enlarged fragmentary sectional view through the apparatus taken substantially along the plane of sheet transport at a cycle stage just prior to deck retraction and disengagement;

FIG. 5 is a top plan view of the apparatus and with portions thereof omitted for clarity and showing the feed roller which lifts and transports successive top sheets and a pair of opposed air rifflers which serve to assist separation of the top sheet from the sheets therebeneath;

FIG. 6 is a sectional view taken substantially along the line 6—6 of FIG. 5 and showing the feed roller in greater detail;

FIG. 7 is an auxiliary view taken substantially along the line 7—7 of FIG. 5 and showing, in elevation, one of the air rifflers.

DESCRIPTION OF THE PREFERRED EMBODIMENT

Figure 1:
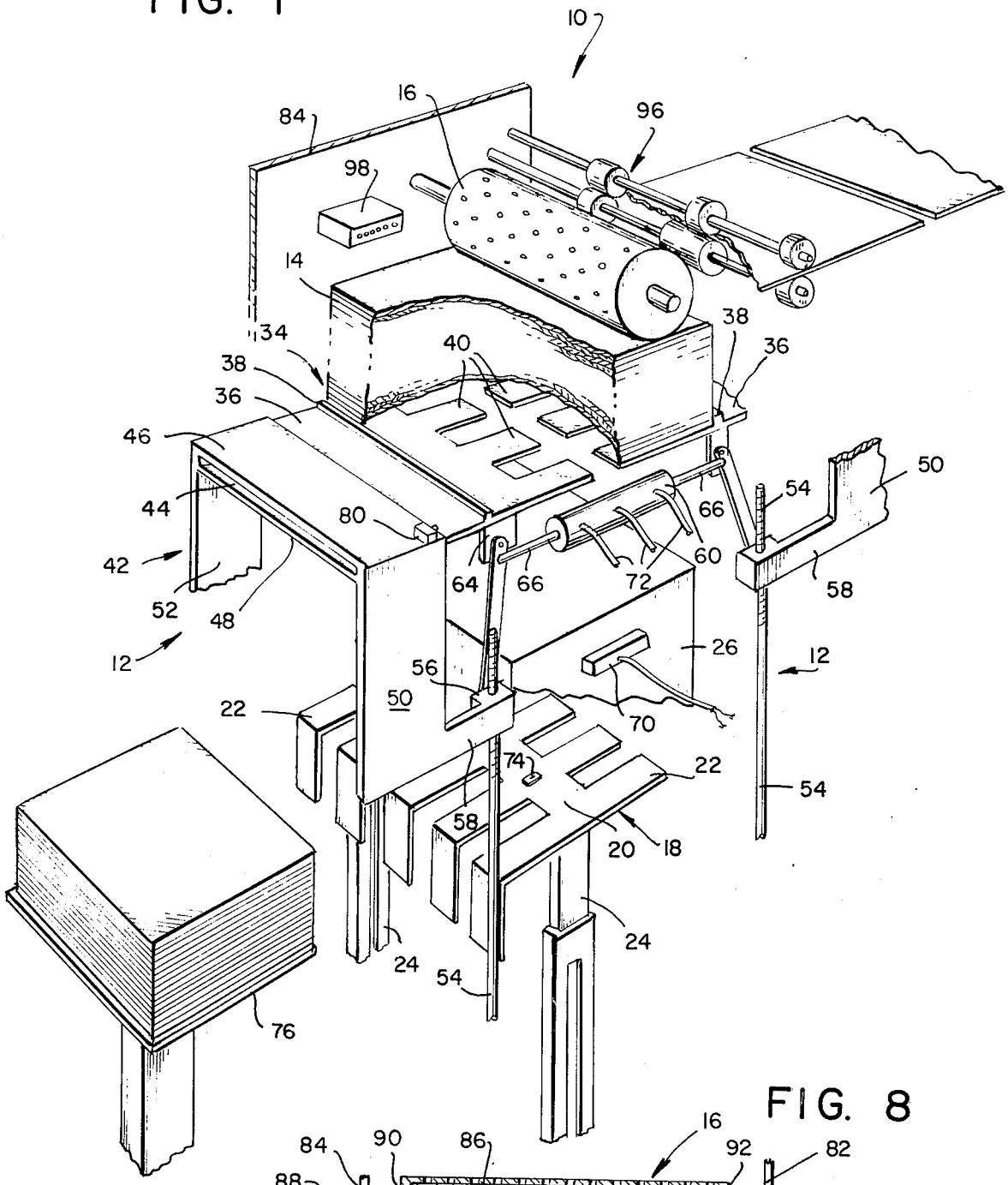
FIG. 1 is a perspective illustration of a sheet feeder including a stack lifting apparatus constructed in accordance with and embodying the invention with portions thereof broken away for clarity and showing a pair of feeding decks elevating a reserve stack to a top-of-stack feed roller, while a feeding platform is at a loading station.
Figure 8:
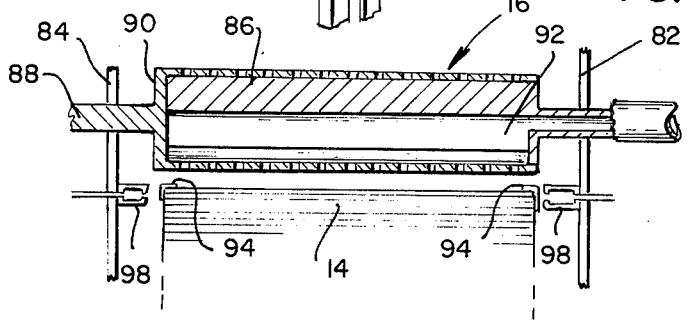
FIG. 8 is a sectional view taken substantially along the line 8—8 of FIG. 5 and showing further details of the feed roller and air rifflers.

In accordance with the invention, a feed stack lifting and loading apparatus is provided in conjunction with a top-of-stack sheet feeder, to provide high speed sheet feeding in an environment such as a continuous flow automated paper sheet document handling system. Overall system requirements for such applications necessitate a high speed reliable sheet feeder capable of separation and transport of individual sheets from a feed stack without feeding doubles or jamming. Further requirements include the capability of reloading without interruption of feeding, especiallly in continuous flow systems which include subsequent scanning of transported sheets for information retrieval and/or further processing as, for instance, the collation and routing of paper sheet documents for delivery.

Referring now in detail to the drawings wherein the reference numeral 10 denotes generally a stack feeding apparatus constructed in accordance with and embodying the invention, the apparatus includes a stack lifting assembly 12 adapted to elevate a stack 14 of sheets lying generally in a horizontal plane to position successive top sheets of said stack in operative registration with a feed roller 16 by applying an upward stack lift.

Figure 2:
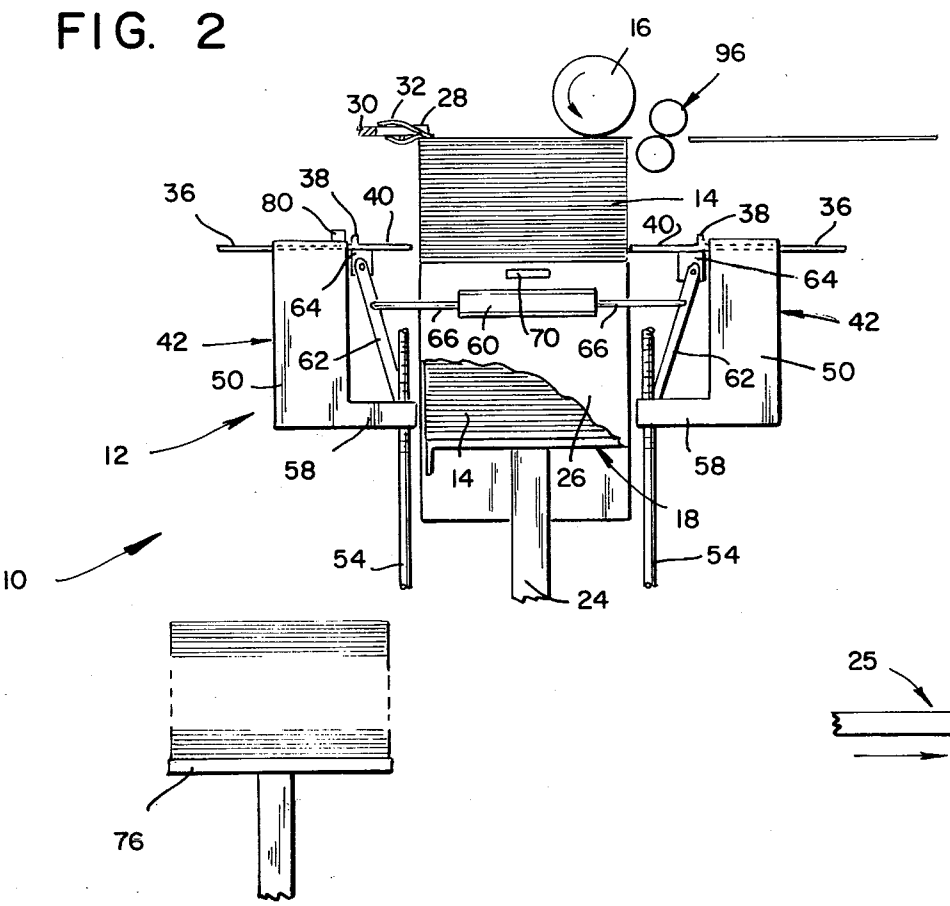
FIG. 2 is a front elevation view thereof with the platform operatively elevating a stack to the feed roller and with the decks being maintained at a dwell station.

In FIG. 2 a full stack 14, e.g. 800 document sheets, is shown resting on a feeding platform 18 which lifts or elevates the stack while successive top sheets are removed by the roller 16.

The platform 18 lies in a horizontal plane and in plan configuration includes a central longitudinal spine 20 extending transversely to the feed direction, i.e. the direction of sheet transport, from left to right, as viewed in FIG. 2. A plurality of spaced teeth or fingers 22 project in opposite directions from the spine to support the stack 14. To facilitate the sliding transport of stacks to the platform 18 without binding of bottom sheets, an end zone of each of the fingers 22 projecting away from the feed direction is bent downwardly below the plane of the platform.

A pair of telescoping rams 24 are secured to the undersurface of the platform 18 and are operative to provide vertical movement of the platform from a loading station (shown in FIGS. 1 and 3) through a feeding zone wherein the platform elevation is incremental. After a stack 14 is transported to the platform 18 at the loading station, a signal is actuated by retraction of a transfer mechanism 25 to initiate platform movement at a rapid rate elevating the stack 14 to the feeding zone wherein the stack elevation proceeds at a slower rate. The stack 14 is lifted through rectangular feed hopper 26 having an open top and bottom and generally planar side walls. The side walls of the hopper may be downwardly outwardly flared to facilitate sheet alignment.

Platform elevation in the feeding zone is responsive to requirement signals generated by a top sheet height sensor 28. The sensor 28 is secured in fixed position adjacent the trailing edge of the top sheet of the stack 14. In operation, the sensor 28 provides a discrete signal initiating an elevating force through the rams 24, lifting the platform 18, a distance sufficient to compensate for the removal of each successive top sheet by the feeder 16. Thus, the platform 18 incrementally elevates the feed stack 14 in response to the removal of successive top sheets thereby avoiding variations of stack pressure at the roller 16 due to stack depletion.

The top sheet sensor 28 may comprise any conventional switching device capable of position detection, such as, but not limited to, photoelectric detecting systems, radio detection systems, lever arm snap switches, and the like. In an exemplary manner, the sensor 28 is shown in the drawings as a lever arm actuated snap switch secured to a fixed support 30. With reference to FIG. 5, it will be observed that to insure accuracy in height detection a pair of leaf springs 32, each secured at one end to the support 30, have their free ends biased against the top sheet of the stack 14 straddling the lever arm of the sensor 28. It should be appreciated that to minimize both top sheet drag and intersheet adhesion, the springs 32 exert but a minimal downward force.

The application of a lifting force to advance the platform 18 in response to the requirement signals of sensor 28 while successive top sheets are removed from the stack 14 is achieved through conventional motor and drive means applied to the rams 24, as by a stepping motor with associated drives. Although actual platform and stack elevation is incremental responsive to a discrete requirement signal generated by the detection of the elevation of the new top sheet of the stack, the incremental advances in elevation will appear to be as a continuous, gradual movement of the platform 18 and feed stack 14 when sheets are fed at average operating rates of approximately 4–10 sheets per second.

As mentioned heretofore, a principal problem of prior feeding apparatus was the inability to replenish feed stack supply on an automated basis and without the interruption of a reliable high speed sheet feeder. The present invention achieves such stack replenishment without sheet feeder interruption through the utilization of a pair of opposed feeding decks 34, which are adapted to conjointly assume the stack elevating function by elevating the feed stack reserve on a transitory basis during which period the platform 18 descends to the loading station to receive a new stack.

Each deck 34 is formed of a comblike horizontal plate 36 with a plurality of spaced rectangular fingers 40 projecting from one edge thereof. A vertical flange or back 38 projects upwardly from the base of the fingers 40 and serves as a stack abutment. The fingers 40 are smaller than and registered with the clear areas separating the fingers 22 of the platform 18 to thereby permit engagement between the decks 34 and the stack reserve when the platform 18 and decks 34 are at the same elevation by lifting the deck fingers up between the platform fingers.

Each deck 34 is mounted for horizontal movement toward and away from the stack with one deck engaging the stack at the leading edge (with respect to top sheet transport) and the other at the trailing edge. Further movement of the decks 34 includes upward movement at a rate greater than the platform elevation rate prior to stack engagement, stack elevation under control of the sensor 28 upon stack engagement, and downward indexing to dwell positions when disengaged from the stack.

Various mechanisms may be employed to provide the desired tandem reciprocal deck movements and by way of example only the apparatus 10 utilizes a pair of carriers 42, each supporting one of the decks 34. Each carrier 42 includes an upper, generally planar, horizontal channel 44 formed between parallel top and bottom panels 46, 48 respectively and within which the deck plate 36 is slidably received for movement in a horizontal plane. A pair of side panels 50, 52 depend from opposite ends of the top and bottom panels 46, 48 and provide side closures for the channel 44.

Vertical movement is imparted to the carriers 42 through a plurality of drive screws 54, each of which engages a drive nut 56, affixed to a leg 58 extending toward the feed stack from the lower end of each side panel 50, 52. The drive screws 54 are operably driven by a suitable motor means (not shown) and it should be appreciated that all drive screws 54 are interconnected for operation in unison, thus maintaining both decks 34 in the same horizontal plane at all times.

Horizontal movement of the decks 34 is provided by a pair of fluidic cylinders 60. A pair of links 62 are coupled between opposed pistons of each cylinder 60 to simultaneously urge the decks into and out of engagement with the stack reserve. The lower end of each link 62 is pivotally joined to the drive nut 56 as shown in FIG. 4, while the upper end of the link is pivotally connected to a tab 64 projecting downwardly from the opposite sides of each deck 34 adjacent the rib 38. A rod 66 extends from each piston to its associated link 62.

In FIG. 2 the decks 34 are illustrated in their dwell, lowermost position, and the apparatus is shown with the feeding platform 18 in the feeding zone. Synchronization of the decks 34 to engage the stack upon depletion to a predetermined reserve is achieved through a platform sensor 70 secured to the feed hopper 26. The sensor 70 includes means extending into the hopper and engaged by the platform when the platform has reached the elevation of the sensor. A typical conventional sensor which may be employed could be a lever arm snap switch.

Actuation of the sensor 70 signals the depletion of the stack 14 to the predetermined reserve level, e.g. 200 document sheets, and initiates fluidic control flow through conduits 72 (shown in FIG. 1) to draw the rods 66 toward the cylinders 60, causing the decks 34 to move toward one another beneath the platform 18 until the ribs 38 are registered with the respective stack reserve edges. Simultaneously, the drive screws 54 are actuated to lift the decks upward at a speed greater than the platform elevation rate so that the decks 34 will engage the bottom of the stack reserve at the spaces between the platform fingers 22.

Figure 3:
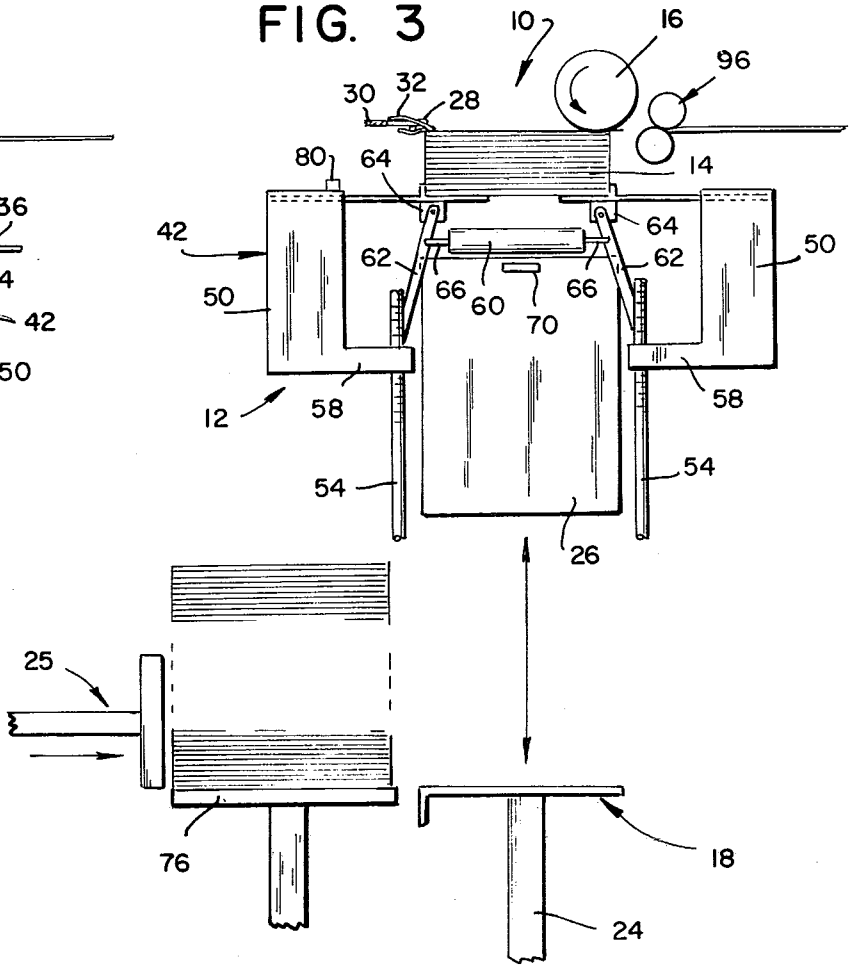
FIG. 3 is a front elevation view thereof similar to that of FIG. 2 showing, however, the apparatus in the cycle stage illustrated in FIG. 1.

A suitable detector, such as a lever snap switch 74 (see FIG. 4) mounted to the undersurface of the platform 18, signals the relief of stack weight from the platform and initiates slower deck elevation under the control of the sensor 28, the disengagement of the platform 18 from control by the sensor 28 and the lowering of the platform to a receiving station which position is shown generally in FIG. 3. At the receiving station a transfer mechanism 25 transfers a replenishment stack from a reservoir 76 to the platform 18. Retraction of the transfer mechanism 25 initiates a platform control to elevate the replenishment stack into the feed hopper 26.

Deck retraction and reassumption of combined stack elevation by the platform is synchronized by a sensor 78 which detects the presence of the top sheet of the replenishment stack against the undersurface of the fingers 40 of the feed decks 34. As with the prior sensors, the sensor 78 is shown by way of illustration only as a lever arm snap switch. Detection of the replenishment stack by the sensor 78 initiates both incremental elevation of the platform under control of the sensor 28 and fluidic controls to the cylinder 60 urging the rods 66 apart, which disengages the decks by forcing the links 62 apart. In order to minimize stack pressure disturbance upon deck retraction, the thickness of the fingers 40 is in the order of approximately 1/16 inches and therefore disengagement of the decks 34 will provide only a negligible drop in the elevation of the top sheet which is automatically compensated by the sensor 28. Further, since both decks 34 retract simultaneously toward opposite edges of the stack, no disruption in combined stack registration results, and a new combined stack 14 is provided and incrementally elevated by the platform 18.

Upon deck retraction, a suitable signal is generated, for instance by the rib 38 engaging a sensor 80 on the top panel 46. The signal initiates the drive screws 54 to lower the carriers 42, hence the decks 34, to the dwell position illustrated in FIG. 2 ready to engage the stack upon depletion to the reserve level.

With reference to FIGS. 5 through 8 wherein the feed roller 16 is shown in greater detail, it will be seen that the roller is mounted for rotation between a pair of parallel frame walls 82, 84, illustrated in FIG. 5. The roller 16 constructed of a thin-walled cylinder having a plurality of perforations and journalled on a stationary steel core 86 is driven by a shaft 88 which extends through the wall 84 and is fixed to a terminal cap 90 of the roller.

The core 86 includes an open wedge sector 92 extending along its longitudinal axis and open along the core periphery. The sector 92 is operatively connected to a source of low pressure (vacuum) through conventional fittings.

From an observation of FIG. 6 it will be appreciated that the sector 92 faces the top sheet of the stack 14 and the vacuum or low pressure area of the sector is ported through the perforations in the roller 16 to provide a normal lifting force against the top sheet of the stack 14. The top sheet is lifted against the restraint of a pair of thin triangular corner separators 94 supported from the walls 82, 84. Rotation of the roller 16 transports the lifted top sheet into a set of opposed acceleration rollers of conventional configuration and designated generally by the reference numeral 96. The acceleration rollers 96 have a peripheral velocity greater than that of the feeder roller 16, and sufficient driving force is provided to pull the top sheet away from the feed roller.

Top sheet lifting by the feed roller 16 is assisted by a pair of air rifflers 98, each secured to one of the walls 82, 84 and supplied from a source of pulsating air flow (not shown). The rifflers are located adjacent the top of the feed stack and on each side of the feed roller 16. The rifflers 98 include a plurality of nozzles which direct the pulsating air flow under the top sheet of the feed stack and tend to lift the top sheet toward the roller 16.

Further, in addition to decreasing the intersheet drag, the induced air pulses on the undersurface of the top sheet assures the presence of at least atmospheric pressure between the top sheet and the sheet beneath, thus preventing the vacuum lifting force from lifting two sheets simultaneously.

Thus, it will be seen that there is provided a sheet feeder which achieves the various objects of the invention and which is well suited to meet the conditions of practical use.

As various changes might be made in the sheet feeder as above set forth, it is to be understood that all matter heretofore described or shown in the accompanying drawings is to be interpreted as illustrative and not in a limiting sense.

Having thus described the invention, there is claimed as new and desired to be secured by Letters Patent:

1. Sheet feeding apparatus comprising:

a. means for removing successive top sheets from a stack of sheets, said removing means including feed roller means and vacuum means, the vacuum means operatively connected to the feed roller means for lifting successive top sheets off the stack and into engagement with the feed roller means for transportation thereby away from the stack;

b. primary means for positioning the stack, said primary positioning means including a platform for supporting the stack thereon and means for moving said platform;

c. first top sheet sensing means for sensing successive top sheets of the stack, said first top sheet sensing means adapted to incrementally operate the platform moving means for elevating the platform to maintain a supply of top sheets of the stack in operative engageable relationship with the removing means;

d. secondary means for positioning the stack, said secondary positioning means including at at least one deck for supporting a reserve portion of the stack and means for moving said at least one deck;

e. means for sensing a first level of the platform, said first platform level sensing means adapted to operate the deck moving means for moving said at least one deck into supporting engagement with the stack reserve portion, said first platform level sensing means adapted to operate said platform moving means for lowering the platform to a second level to permit loading thereon a replenishing supply of sheets;

f. said first top sheet sensing means adapted to incrementally operate the deck moving means for elevating said at least one deck to maintain the supply of top sheets in operative engageable relationship with the removing means;

g. means for operating said platform moving means to raise the platform from said second level after the replenishing supply has been loaded thereon;

h. second top sheet sensing means for sensing a level of the top sheet of the replenishing supply, said second top sheet sensing means adapted to operate said deck moving means for disengaging the deck from the stack reserve portion to permit engagement with the replenishing supply, whereby the stack reserve portion is combined with the replenishing supply on the platform to form therewith a new stack of sheets.

2. The sheet feeding apparatus according to claim 1, wherein said platform includes finger means permitting said platform and said at least one deck to be disposed at the same elevation.

3. The sheet feeding apparatus according to claim 1, wherein said at least one deck includes finger means permitting said at least one deck and said platform to be disposed at the same elevation.

4. The sheet feeding apparatus according to claim 1, wherein said at least one deck includes a pair of oppositely disposed decks, said deck moving means including means for moving said decks in tandem such that said decks are movable toward one another for engagement with the stack reserve portion and away from one another for disengagement therefrom.

5. The sheet feeding apparatus according to claim 1, wherein said platform includes a spine portion and a plurality of first finger members extending therefrom, said at least one deck including a second spine portion and a plurality of second finger members extending therefrom, and said first and second finger members disposed out of registration with one another so as to permit concurrent disposition of said platform and said at least one deck in engagement with the bottom sheet of the stack reserve portion.

6. The sheet feeding apparatus according to claim 1, wherein said first platform level sensing means is adapted to signal said first top sheet sensing means to commence incrementally operating the deck moving means.

7. The sheet feeding apparatus according to claim 1, wherein said first platform sensing means is adapted to signal said first top sheet sensing means to discontinue operating said platform moving means.

8. The sheet feeding apparatus according to claim 1, wherein said means for operating said platform includes means for sensing that the replenishing supply of sheets has been loaded on the platform.

9. The sheet feeding apparatus according to claim 1, wherein said sheet removing means includes air riffler means for separating successive top sheets of the stack from one another.

10. The sheet feeding apparatus according to claim 1 including means for loading a replenishing supply of sheets on the platform at said second level.

* * * * *